US009096975B2

(12) United States Patent
Rischmueller et al.

(10) Patent No.: US 9,096,975 B2
(45) Date of Patent: Aug. 4, 2015

(54) ABUTMENT FOR A MODULAR DECKING SYSTEM

(75) Inventors: Guy Robert Rischmueller, Ringwood (AU); Franek Savarton, Yundi (AU)

(73) Assignee: Ecoform Pty Ltd, Newton, South Australia (AU)

( * ) Notice: Subject to any disclaimer, the term of this patent is extended or adjusted under 35 U.S.C. 154(b) by 108 days.

(21) Appl. No.: 12/666,549

(22) PCT Filed: Jul. 2, 2008

(86) PCT No.: PCT/AU2008/000967

§ 371 (c)(1), (2), (4) Date: Apr. 13, 2010

(87) PCT Pub. No.: WO2009/003232

PCT Pub. Date: Jan. 8, 2009

(65) Prior Publication Data

US 2010/0186338 A1 Jul. 29, 2010

(30) Foreign Application Priority Data

Jul. 2, 2007 (AU) ..... 2007903571

(51) Int. Cl.
*E01C 15/00* (2006.01)
*E01D 1/00* (2006.01)
(Continued)

(52) U.S. Cl.
CPC . *E01C 15/00* (2013.01); *E01D 1/00* (2013.01); *E01D 19/125* (2013.01); *E04B 1/003* (2013.01); *E04F 15/08* (2013.01)

(58) Field of Classification Search
CPC ..... E04B 1/003; E04F 15/08; E01D 19/125; E01D 1/00; E02B 3/06; E01C 15/00
USPC ..... 52/177, 294, 299, 483.1, 610, 650.3, 52/263, 592.1, 604, 284, 245, 246, 102, 52/561; 14/73.5, 73, 75; 57/263, 650.3; 403/90, 92
See application file for complete search history.

(56) References Cited

U.S. PATENT DOCUMENTS 584,865 A * 6/1897 Fisher ..... 52/169.14
2,074,483 A * 3/1937 Mason et al. ..... 52/169.1
(Continued)

FOREIGN PATENT DOCUMENTS

DE 8110959 U1 8/1981
DE 19738477 A1 * 3/1999 ..... E04F 15/024
(Continued)

*Primary Examiner* — Joshua J Michener
*Assistant Examiner* — Theodore Adamos
(74) *Attorney, Agent, or Firm* — Fitch Even Tabin & Flannery LLP

(57) ABSTRACT

An abutment for use with a modular decking system that includes decking in the form of a plurality of treads, each tread being elongate and having a longitudinal axis, a topside, an underside and two ends having respective end surfaces, the underside of at least a first end of each tread including a tread coupling member. The abutment includes a tread receiving portion configured to receive the underside of the first end of each tread to thereby support the decking, the tread receiving portion including an abutment coupling member for engagement with the tread coupling member of each tread so as to prevent longitudinal movement of each received tread. The abutment also includes an upright margin configured such that the end surface of the first end of a received tread can lie closely adjacent thereto to provide a border for the decking.

18 Claims, 8 Drawing Sheets

(51) Int. Cl.

| | |
|---|---|
| ***E01D 19/12*** | (2006.01) |
| ***E04B 1/00*** | (2006.01) |
| ***E04F 15/08*** | (2006.01) |

(56) References Cited

U.S. PATENT DOCUMENTS

| | | | | | |
|---|---|---|---|---|---|
| 3,528,391 | A * | 9/1970 | Johnson | 119/529 |
| 3,721,215 | A * | 3/1973 | Vickstrom et al. | 119/529 |
| 4,335,557 | A * | 6/1982 | Morton | 52/745.05 |
| 5,134,817 | A * | 8/1992 | Richardt | 52/102 |
| 5,404,683 | A * | 4/1995 | Hammonds et al. | 52/263 |
| 5,625,987 | A * | 5/1997 | Zamerovsky | 52/263 |
| 5,729,940 | A * | 3/1998 | Bullivant | 52/299 |
| 5,906,084 | A * | 5/1999 | Millington et al. | 52/650.3 |
| 6,141,927 | A * | 11/2000 | Usui | 52/263 |
| 6,194,051 | B1 * | 2/2001 | Gagas et al. | 428/99 |
| 6,226,941 | B1 * | 5/2001 | Stevens | 52/302.3 |
| 6,237,291 | B1 * | 5/2001 | Elwart | 52/250 |
| 6,574,818 | B1 * | 6/2003 | Matiere | 14/77.1 |
| 6,895,623 | B2 * | 5/2005 | Zimmerlee | 14/75 |
| 7,628,570 | B2 * | 12/2009 | Davidsaver et al. | 405/284 |
| 2002/0078646 | A1 * | 6/2002 | Eaton | 52/292 |
| 2003/0029114 | A1 * | 2/2003 | MacDonald et al. | 52/562 |
| 2004/0128939 | A1 * | 7/2004 | Kim et al. | 52/650.3 |
| 2004/0134154 | A1 * | 7/2004 | Bott | 52/604 |
| 2006/0101773 | A1 * | 5/2006 | Turner et al. | 52/650.3 |
| 2007/0028550 | A1 * | 2/2007 | Clapper | 52/650.3 |
| 2007/0130875 | A1 * | 6/2007 | Detal | 52/650.3 |
| 2009/0025308 | A1 * | 1/2009 | Deans et al. | 52/92.2 |
| 2009/0151275 | A1 * | 6/2009 | Naccarato et al. | 52/182 |
| 2009/0301024 | A1 * | 12/2009 | Rischmueller et al. | 52/650.3 |
| 2010/0064454 | A1 * | 3/2010 | Grace | 14/73 |
| 2010/0180532 | A1 * | 7/2010 | Martel | 52/650.3 |
| 2010/0223880 | A1 * | 9/2010 | Smith et al. | 52/778 |

FOREIGN PATENT DOCUMENTS

| | | | | |
|---|---|---|---|---|
| DE | 297 24 621 | U1 | 9/2002 | |
| JP | H11-350409 | A | 12/1999 | |
| JP | 2000-096765 | A | 4/2000 | |
| JP | 2000-265410 | A | 9/2000 | |
| JP | 2000265410 | A * | 9/2000 | E01C 11/02 |
| JP | 2003-293305 | A | 10/2003 | |
| JP | 2003293305 | A * | 10/2003 | E01C 11/00 |
| WO | WO 2007/051934 | A1 | 5/2007 | |
| WO | WO 2008/000021 | A1 | 1/2008 | |

* cited by examiner

ABUTMENT FOR A MODULAR DECKING SYSTEM

CROSS-REFERENCE TO RELATED APPLICATIONS

This application is a U.S. national phase application filed under 35 U.S.C. §371 of International Application PCT/AU2008/000967, filed on 2 Jul. 2008, designating the United States, which claims priority from Australian provisional patent application 2007903571 filed on 2 Jul. 2007, the contents of which are to be taken as incorporated herein by this reference.

FIELD OF THE INVENTION

The present invention relates to an abutment for use in supporting the treads of a modular decking system, and thus also relates to an improved modular decking system that utilises the abutment. In this respect, the modular decking system is preferably of the type that may be used for paths, boardwalks, platforms, decking, promenades, cantilevered walkways, jetties, piers, verandahs, and small crossings such as pedestrian bridges, or the like. It is envisaged that such modular decking systems will find particular use as boardwalks through environmentally sensitive areas such as wetlands and sand dunes, or as promenades along waterfronts and the like.

BACKGROUND OF THE INVENTION

Most available decking systems require the use of heavy equipment for their in situ construction, and also require the preparation of substantial foundations or footings. In most situations, and certainly in environmentally sensitive situations, these requirements cause significant damage to the surrounding areas.

Additionally, many areas in which in situ decking systems are required are irregular in terms of terrain, and introduce design and planning difficulties where a flat surface is required over undulating features. In particular, laying paths, tracks or boardwalks through wetland areas requires careful planning and surveying of levels to ensure the various components of the path are constructed to design levels correctly, whilst even a small margin of error can cause significant construction difficulties.

In general, traditional in situ timber decking systems are subject to much error in such situations, with subsequent wastage of materials and long installation times or delays in construction.

Furthermore, many of the environments in which such decking is required are quite harsh and corrosive, and are thus environments that will rapidly deteriorate and weather-damage traditional decking materials such as timber and steel. Concrete is thus a preferred material for such environments, but its use has typically been avoided for such decking due to the difficulty of in situ construction, especially where site access is restricted due to physical or environmental reasons. Furthermore, the traditional use of steel connectors and fixing materials such as nails, screws and bolts in decking systems are similarly prone to deterioration.

Our U.S. Pat. No. 5,906,084 describes an improved modular decking system which overcomes, or at least partly alleviates, the abovementioned difficulties. Our co-pending international patent application PCT/AU2007/000880 (WO 2008/000021) additionally describes an improved tread and bearer member locating system for use with the modular decking system of U.S. Pat. No. 5,906,084, which further improves and optimises the installation and inspection processes of that modular decking system and avoids the use of corrosion vulnerable fixtures and connectors.

However, a need has been identified for further improvement to the modular decking system, particularly in situations where it is possible (or essential) to construct the decking system so as to be in continuous contact along one of its sides with a continuous land mass. For example, in the case where the decking system is being constructed to provide a promenade along a foreshore where one side of the promenade is constructed on land and the other side is constructed over the water, an opportunity arises to use a form of continuous support for the landside of the promenade. Such a continuous support avoids the need to use stumps and bearers, which can simplify installation and can reduce the number of required components.

It is an aim of the present invention to provide an abutment for use in a modular decking system, which abutment is able to provide a useful construction alternative and additional design options for the systems described in our abovementioned patent and patent application.

Before turning to a summary of the present invention, it must be appreciated that the above description of the prior art has been provided merely as background to explain the context of the invention. It is not to be taken as an admission that any of the material referred to was published or known, or was a part of the common general knowledge in Australia or elsewhere.

It is also useful to provide an explanation of some of the terms that will be used to define the spatial relationship of the abutment and of the modular decking system. In this respect, spatial references throughout this specification will generally be based upon a decking that is constructed and installed so as to be generally horizontal. With this environment as the basis, the abutment and the modular decking system may then be defined with reference to the "horizontal", allowing further references to "upper" or "upwardly" and "lower" or "downwardly", and also to the "vertical".

Finally, some aspects of the present invention that may ultimately be claimed in isolation (and not in an in-use environment), may nonetheless be difficult to describe and understand in isolation. Thus, some of the following description does describe the invention and its embodiments in such an in-use environment (for example, an abutment in association with the treads and decking of a modular decking system).

Of course, it must be appreciated that the use of such description, and the use of the abovementioned spatial relationships, to define the present invention, is not to be seen as a limitation and certainly is not to be seen as a limitation only to the in-use environment, unless that intention is clearly stated.

SUMMARY OF THE INVENTION

The present invention provides an abutment for use with a modular decking system that includes decking in the form of a plurality of treads, each tread being elongate and having a longitudinal axis, a topside, an underside and two ends having respective end surfaces, the underside of at least a first end of each tread including a tread coupling member, the abutment including:

- a tread receiving portion configured to receive the underside of the first end of each tread to thereby support the decking, the tread receiving portion including an abutment coupling member for engagement with the tread coupling member of each tread so as to prevent longitudinal movement of each received tread; and an upright margin configured such that the end surface of the first end of a received tread can lie closely adjacent thereto to provide a border for the decking.

The present invention also provides a modular decking system that includes decking in the form of a plurality of treads, each tread being elongate and having a longitudinal axis, a topside, an underside and two ends having respective end surfaces, the underside of at least a first end of each tread including a tread coupling member, the modular decking system also including an abutment, the abutment including:

a tread receiving portion configured to receive the underside of the first end of each tread to thereby support the decking, the tread receiving portion including an abutment coupling member for engagement with the tread coupling member of each tread so as to prevent longitudinal movement of each received tread; and an upright margin configured such that the end surface of the first end of a received tread can lie closely adjacent thereto to provide a border for the decking.

In a preferred form, the coupling members (being the tread coupling member and the abutment coupling member) are provided by interacting male and female coupling members. In one form, a male coupling member may be provided by one of an upper surface of the tread receiving portion of the abutment, or by the underside of the first end of a tread, with a female member then being provided by the other of the underside of the first end of a tread or the upper surface of the tread receiving portion of the abutment. In this respect, while the provision of a female coupling member will, by definition, require a formation of some sort within the relevant surface, it should be appreciated that this need not be the case for a male coupling member. Indeed, a male coupling member may be provided either by being integrally formed within or as a part of a relevant surface, or may alternatively be formed by an arrangement of separate parts that interact with that surface to thereby form the male coupling member.

In one form, a male coupling member can be provided by a rib provided in the tread or abutment, and a female coupling member can be provided by a correspondingly shaped groove provided in the other of the abutment or tread respectively. Alternatively, the male coupling member can be provided by at least one locating projection extending away from the surface in which it is located, and the female coupling member is a correspondingly shaped aperture located in the opposed surface. Ideally, the male coupling member will be provided by the underside of the first end of each tread and the female coupling member will be provided by the upper surface of the tread receiving portion of the abutment.

In the most preferred form, the upper surface of the tread receiving portion of the abutment includes an elongate groove (being an abutment coupling member), which extends continuously therealong to receive in any position a downwardly extending locating projection (being a tread coupling member) formed in the underside of the first end of a tread. A series of similarly configured treads can then be easily positioned along the abutment without the need for careful and precise alignment during installation.

With particular regard to the locating projections, preferably they will be formed integrally with the tread, and thus will be of the same material of construction as the tread. However, the locating projections may be formed separately of the treads and then rigidly secured thereto in a suitable manner. Also, the locating projections can be of any suitable size and shape. It is envisaged that locating projections that are generally cylindrical with a diameter in the range of 15 to 50 mm, and a height in the range of 15 to 50 mm, will suffice. However, elongate ribs, also with a height in the range of 15 to 50 mm will also suffice.

As mentioned above, the upright margin of the abutment of the present invention is configured such that the end surface of the first end of a received tread can lie closely adjacent thereto to provide a border for the decking. Ideally, the upright margin will extend upwardly by a distance at least equal to the thickness (or height) of the received treads, so as to form a flush upper surface therewith.

However, it is envisaged that in many forms of the invention the upright margin will extend upwardly beyond the height of the received treads and will play further functional roles in the modular decking system. Such further functional roles will now be described.

In one form, the upright margin can extend above the height of the received treads to provide a small wall or kerb (or retaining wall) as the border of the decking, upon which there may be located a seat or the like. Also, a modular fencing system or hand rail may be secured in an appropriate manner to the upright margin, again to assist with the provision of a suitable border for the decking.

In another form, the upright margin will preferably extend above the height of the received treads and will include a restraining shoulder therein capable of receiving the end of a tread therebelow to prevent substantial vertical movement (off the tread receiving portion of the abutment) of that end of the received tread. This restraining shoulder then permits the construction of a cantilevered decking (using treads with cantilever portions) in situations where that is desired or required.

In this form, the restraining shoulder can simply be provided by a continuous cavity (such as a channel) formed in the base of the upright margin, at the location in the upright margin where (as mentioned above) the end surface of the first end of a received tread would normally lie closely adjacent to. The continuous cavity is preferably configured to snugly receive the first end of the received tread such that substantially all vertical movement of that first end, in the cantilevered decking configuration, is prevented by the restraining shoulder thereof.

In a preferred form, the abutment will be an integral one-piece member made of concrete. Indeed, preferably each of the components of a modular decking system formed with the abutment of the present invention will be made of concrete. Concrete is a material that is not subject to rapid deterioration as a result of rotting, corrosion or erosion. Additionally, the weight of concrete members is often of assistance with the various locating and connecting requirements utilised in modular decking systems of this type. In particular, it can be seen that by providing the treads in a material such as concrete, the dead weight of the treads assists in ensuring the stability of treads and the dead weight of the abutment assists in achieving other engineering solutions and designs.

Furthermore, it should be noted that concrete provides additional advantages in that the topside of the abutment and of the treads may easily be provided with textures or (in the case of the abutments) shapes in order to improve the aesthetics of the decking system, or for instance in order to improve the slip resistance of the tread surface. Additionally, concrete readily accepts colouring and thus the abutment and the treads may be provided in suitable shades. Of course, while stating herein the advantages of concrete, it is to be appreciated that other suitable materials are not to be precluded from use with the present invention.

The use of a modular decking system, in conjunction with the abutment of the present invention, allows for design flexibility and adjustment in the construction of any such systems. The possibility of adjustment during construction, which adjustment may be attended to at virtually any stage of the construction process, prevents the need for precise dimensions and configurations to be planned before hand. This allows for the decking system to be provided by modular components that are of uniform size and configuration. Additionally, by providing the abutments with tapered end walls, the abutments can provide curvilinear paths as will often be necessary to conform to the required directions for such decking systems.

The improved abutment reduces the number of components required for a modular decking system of the type described in our U.S. Pat. No. 5,906,084, and thus reduces the manufacturing cost of such a modular decking system. Also, by reducing the number of components, and by providing for the easy location of the treads upon such abutments, the speed and cost of installation is reduced. Additionally, the improved abutment can be installed as a superstructure onto seawalls, marine piles, waterfront keywalls, breakwater structures and the like.

BRIEF DESCRIPTION OF DRAWINGS

The present invention will now be described in relation to various preferred embodiments thereof. In this respect, it is to be appreciated that the following description of the preferred embodiments does not limit in any way the generality of the above description.

In the drawings.

DETAILED DESCRIPTION OF THE DRAWINGS

Figure 1:
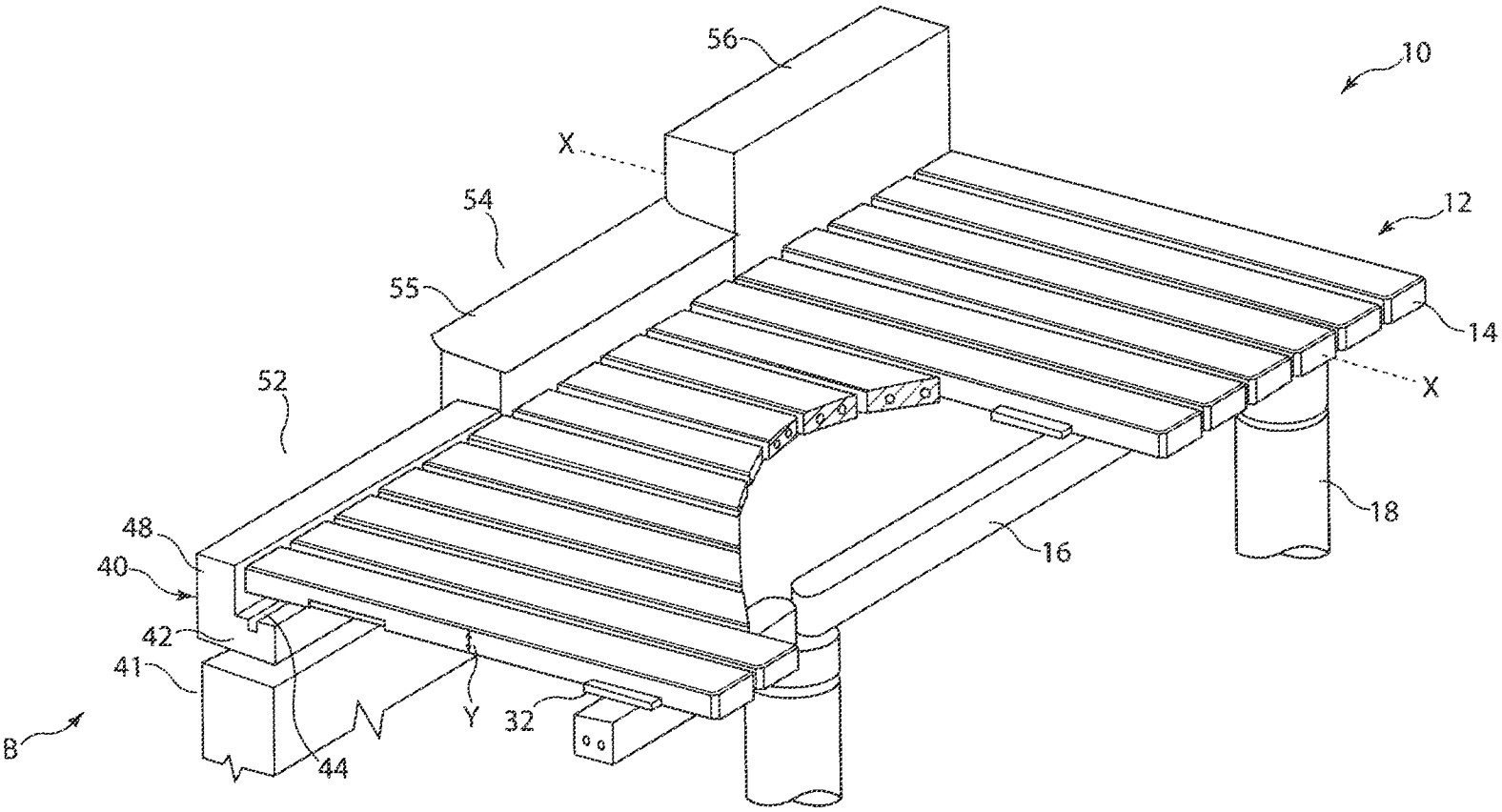
FIG. 1 is a schematic perspective view of a modular decking system in which the abutment of the present invention may find use.

Illustrated in FIG. 1 is a general view of an improved modular decking system 10 constructed in accordance with an embodiment of the present invention. It will be seen from this illustration that the modular decking system 10 includes a decking 12 in the form of a plurality of treads 14 which, along one side A (in this embodiment, the water side), are carried by bearer members 16, which are in turn supported by stumps 18. The stumps 18 serve to support the bearer members 16 a suitable distance above, in this case, the water level. The modular decking system 10 may be used to construct a promenade in the form of elongate planks butted together side-by-side to form a continuous path, the other side B of the promenade being located along a foreshore or the like, such that the promenade extends out over the water away from the foreshore (as is perhaps more evident in FIG. 2).

Each tread 14 is elongate, having a longitudinal axis parallel to the section line X-X and a height indicated by arrow Y, and also having a topside 20, an underside 22, and first and second ends (24,26).

The underside 22 of each tread 14 includes, towards its second end 26, a bearer member receiving area bound longitudinally between a pair of spaced apart, downwardly extending locating projections (28,30), and laterally between opposed coupling members in the form of tongue 32 and groove (not shown) coupling members capable of, in use, coupling with correspondingly shaped groove and tongue coupling members in adjacent treads (this arrangement of adjacent treads being apparent from FIG. 1). This combination of features at this second end 26 of each tread 14 assists in allowing for the accurate location of the treads 14 on the bearer members 16 along the water side A of the modular decking system 10.

Along the foreshore side B of the modular decking system 10 is an abutment 40 that is in accordance with an embodiment of the present invention. The abutment 40 is shown supported by suitable footings 41 as necessary. The abutment 40 includes a tread receiving portion 42 configured to receive the underside 22 of the first end 24 of each tread 14 to thereby support the decking 12. The tread receiving portion 42 is a generally flat area wide enough to receive a substantial portion of the end of each tread 14.

The tread receiving portion 42 includes an abutment coupling member 44 that is a female coupling member in the form of an elongate groove therealong, sized to be suitable for engagement with a tread coupling member (not shown in FIG. 1, but referenced by numeral 46 in FIG. 2) on the underside 22 of each tread 14, the engagement being such that longitudinal movement (which will typically be horizontal movement) of each received tread 14 is substantially prevented.

The tread coupling member 46 is a male coupling member in the form of a downwardly extending locating projection. In this form, the tread coupling member 46 is shown as a lug having a spherical head, the lug having a base that has been inserted into a correspondingly sized and shaped aperture in the underside 22 of the first end 24 of each tread 14. However, it will be appreciated that the tread coupling member 46 could also take the same form as one of the downwardly extending locating projections (28,30) shown as integral projections on the underside 22 of each tread 14 at the second end 26. Indeed, in the embodiments illustrated in FIGS. 4*a* and 4*b* (described below), the tread coupling member 47 is shown as a rib extending the full width of the underside 23 of the first end 25 of the tread 15.

The abutment 40 also includes an upright margin 48 configured such that the end surface 50 of the first end 24 of a received tread 14 can lie closely adjacent thereto to provide a border for the decking 12, as is clearly evident in FIG. 1. In this respect, each tread 14 may be located such that the end surface 50 contacts the upright margin 48 or may be located to leave a small gap therebetween, such as may result from normal engineering tolerances during the manufacture of parts nonetheless intended to fit together in contact. Further, a substantial gap between the end surface 50 and the upright margin 48 may be designed into the modular decking system 10, perhaps due to the likelihood of there being ground movement in the area or perhaps for other functional or aesthetic reasons. Also, any such gap could of course be sealed after installation in any normal manner, particularly if there is a desire to reduce the likelihood of rubbish or waste gathering in the gap in an unsightly manner.

FIG. 1 illustrates three different forms of border provided by the upright margin 48. The first is a simple edging 52 such as is provided by configuring the height of the upright margin 48 to be the same as the height of the decking 12. The second is a low wall 54 that has been provided with a pre-formed seat 55 thereon (as is also evident in FIG. 2). The third is a higher wall 56, seen as a waist high wall in FIG. 1 that may provide both an aesthetic and a physical border along the foreshore side B of the decking 12.

Figure 2:
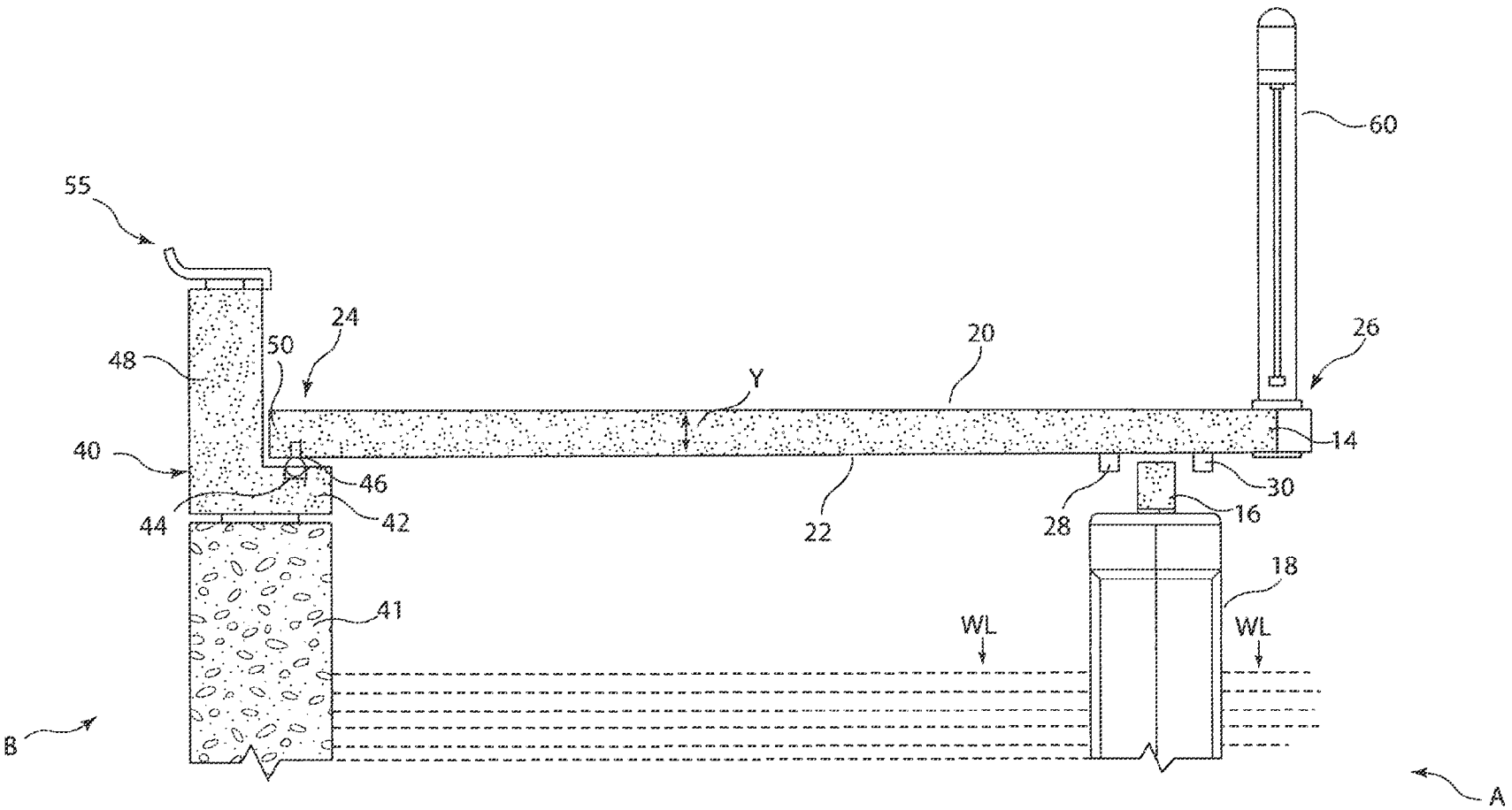
FIG. 2 is a schematic side view through section X-X of the modular decking system shown in FIG. 1.
Figure 3A:
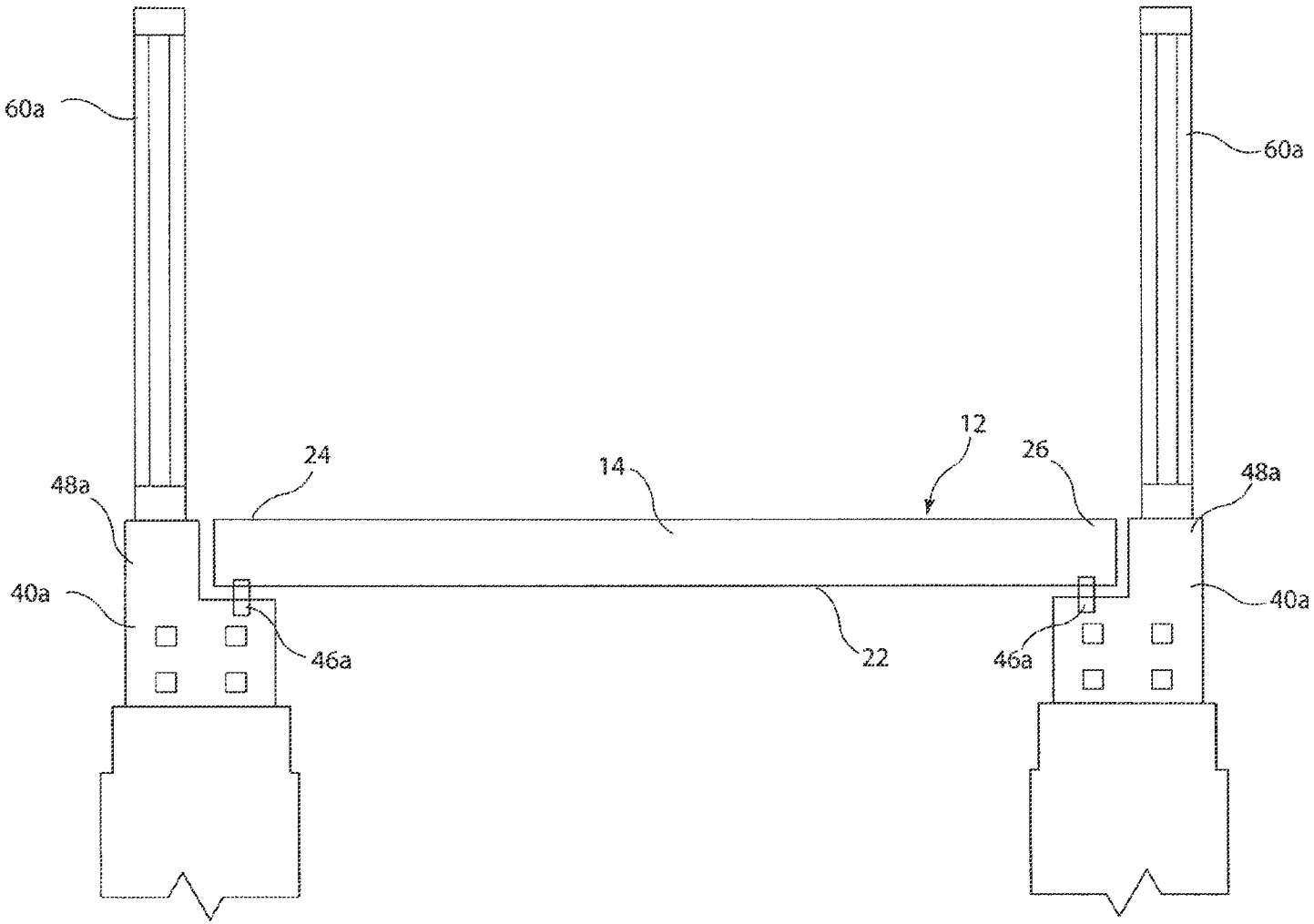
FIGS. 3*a* and 3*b* are schematic side views of two alternative constructions of modular decking systems in which the abutment of the present invention may also find use.
Figure 3B:
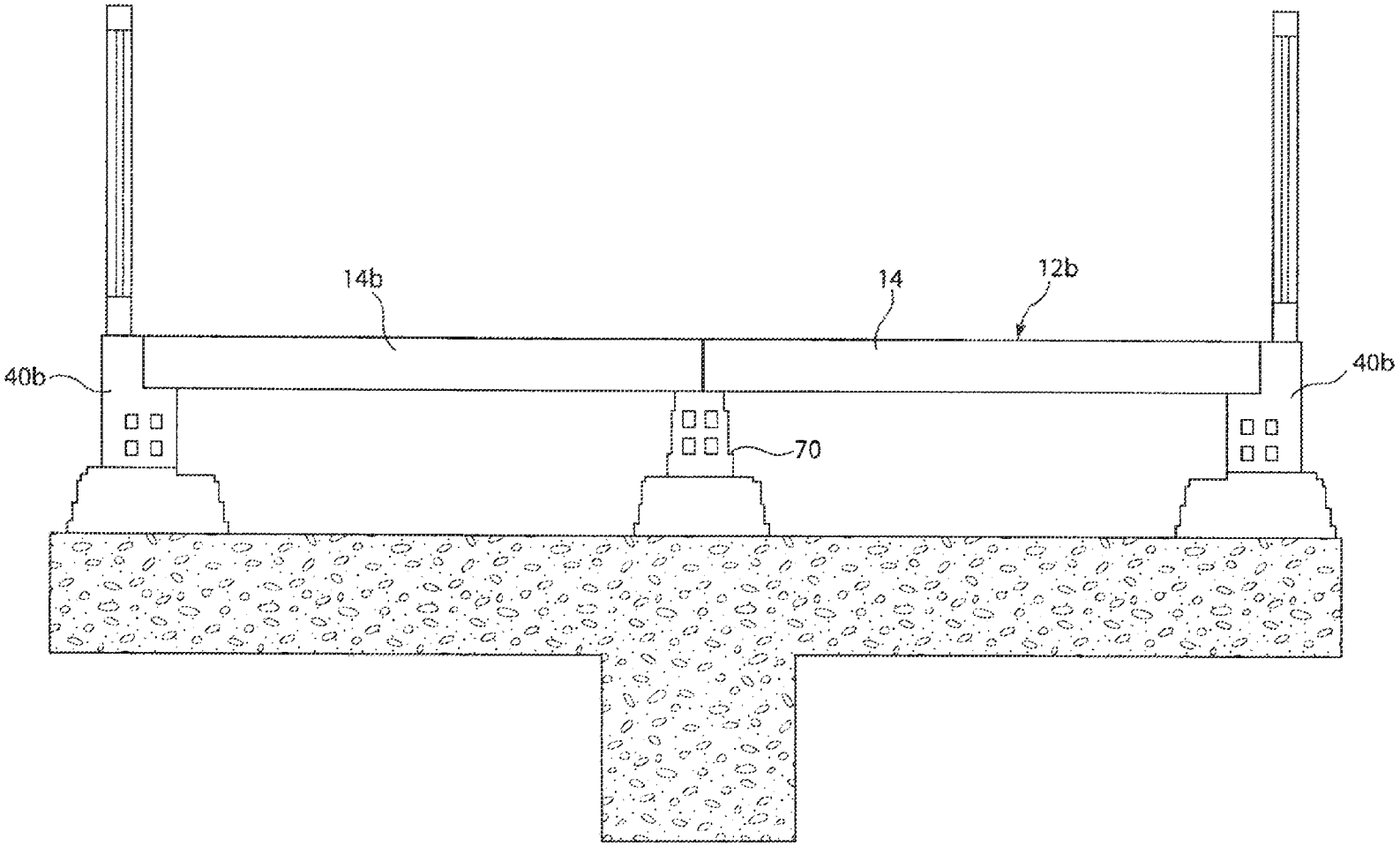

Before turning to a brief description of two alternative forms of modular decking system as shown in FIGS. 3*a* and 3*b*, it will also be apparent from FIG. 2 that suitable ancillary equipment can be easily included in the modular decking system 10, such as is shown by the inclusion of the illustrated fence 60 (not present in FIG. 1).

FIGS. 3*a* and 3*b* illustrate slight variations on the modular decking system 10 shown in FIGS. 1 and 2. These variations show situations where it has been possible to use the abutment 40 (shown by reference numerals 40*a* and 40*b*) on both sides of the decking 12.

Thus, in FIG. 3*a* each tread 14 includes a tread coupling member 46*a* in its underside 22 at both its first 24 and second 26 ends, and each of the abutments 40*a* includes an upright margin 48*a* that provides a suitable border for the decking 12. This version of the modular decking system again includes suitable fencing 60*a* on both sides of the decking 12.

In FIG. 3*b*, a further alternative is shown where a larger span is required and a central pillar 70 is required. In this form, although the central pillar 70 need not include the upright margin of the abutment of the present invention (as shown in FIG. 3*b*), it still includes the tread receiving portion thereof, and indeed includes two such tread receiving portions to support the ends of aligned treads 14*b* and 14*c* to form a wider continuous decking 12*b*. Of course, it will also be appreciated that the central pillar 70 may indeed itself also include an upright margin, centrally located and projecting from the upper surface thereof, which would then advantageously be located between the adjacent ends of the aligned treads 14*b* and 14*c*.

Figure 4A:
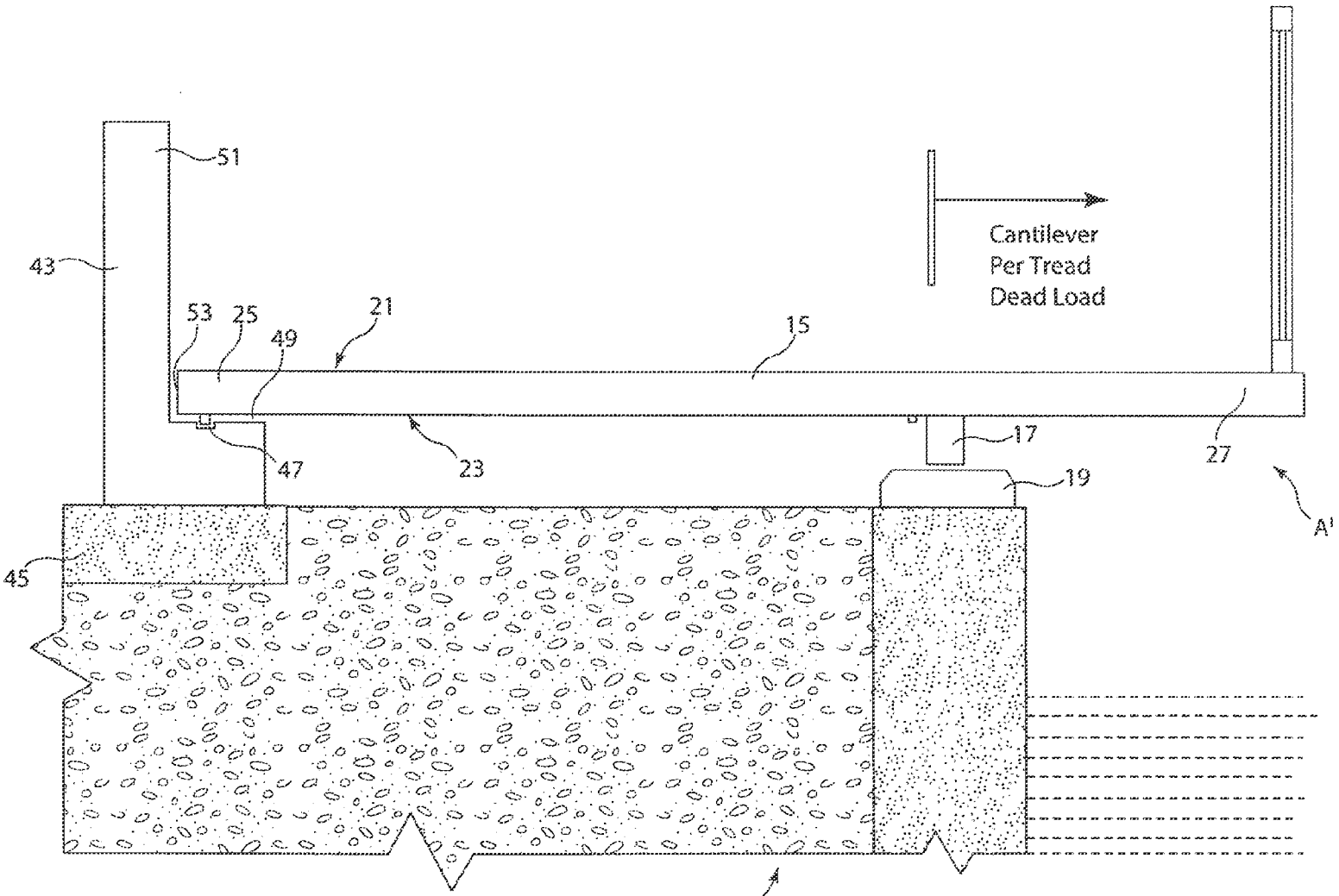
FIGS. 4*a* and 4*b* are schematic side views of two further alternative constructions of modular decking systems in which the abutment of the present invention may find use, with FIG. 4*b* showing a cantilevered decking system.
Figure 4B:
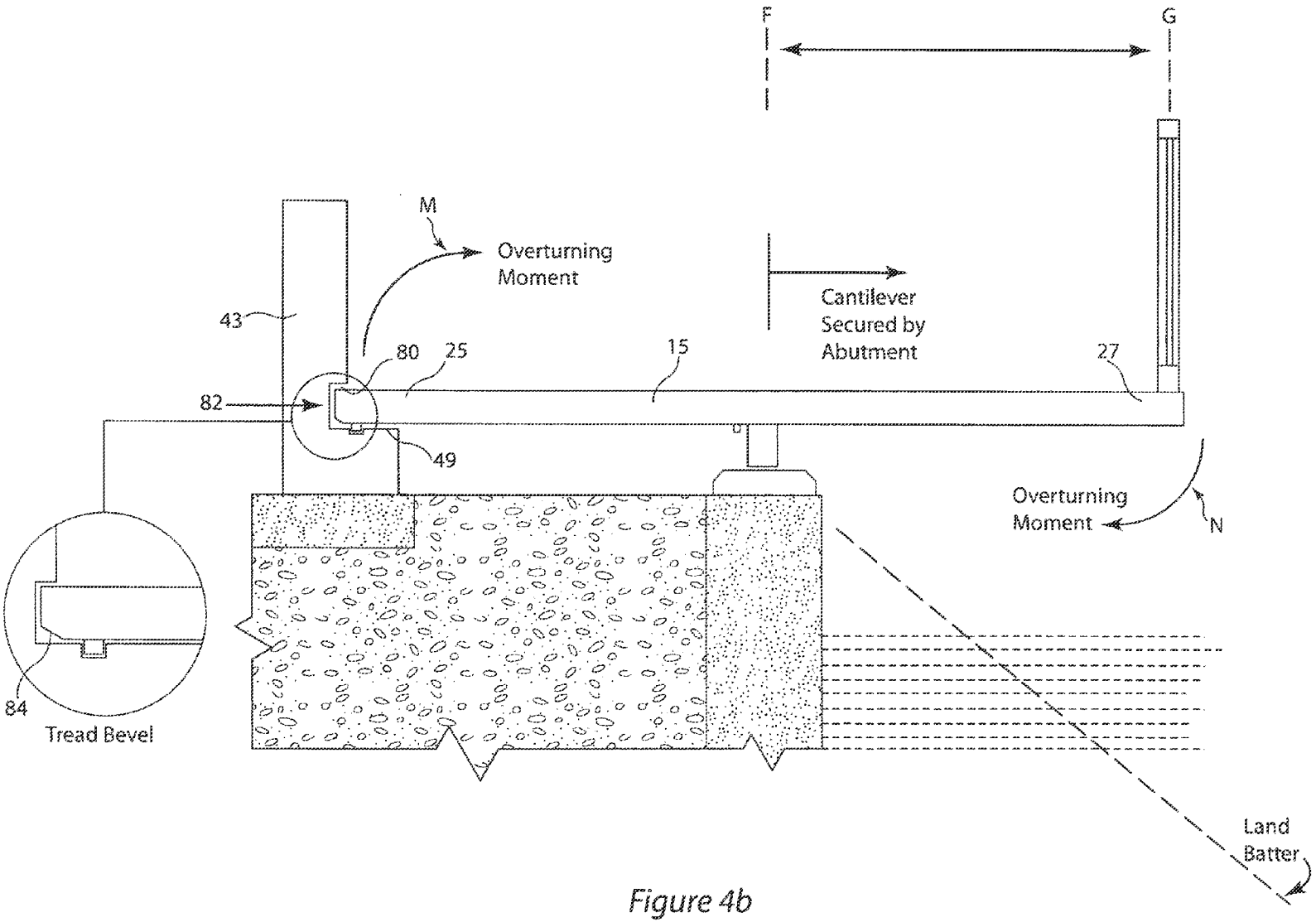

A further alternative embodiment is illustrated in FIG. 4*b*, with a comparative embodiment shown in FIG. 4*a* that is very similar to the embodiment illustrated in FIG. 2. Illustrated in FIG. 4*a* is a plurality of treads 15 which, along one side A' (in this embodiment, the water side), are carried by bearer members 17, which are in turn supported by stumps 19. Each tread 15 is again elongate (as outlined above), having a topside 21, an underside 23, and first and second ends (25,27).

Along the foreshore side B' is an abutment 43 that is in accordance with an embodiment of the present invention. The abutment 43 is shown supported by suitable footings 45 as necessary. The abutment 43 includes a tread receiving portion 49 configured to receive the underside 23 of the first end 25 of each tread 15 to thereby support the decking. The tread receiving portion 49 is a flat area wide enough to receive a substantial portion of the end of each tread 15. The abutment 43 also includes an upright margin 51 configured such that the end surface 53 of the first end 25 of a received tread 15 can lie closely adjacent thereto to provide a border for the decking. As with the embodiments described above, each tread 15 may be located such that the end surface 53 contacts the upright margin 51.

In such a structure, where reliance will be placed on the dead weight of the treads 15, and any associated parts carried by the treads 15, for their stability upon the abutment 43 and the bearers 17, the bearers 17 need to be located close enough to the second end 27 of each tread 15 so as to prevent a load on that second end pivoting about the bearers 17 to lift the first end 25 off the tread receiving portion 49. In the event that there is a desire to increase the distance that the second end 27 projects beyond the bearers 17, to provide a cantilevered tread portion FG (shown in FIG. 4*b*), which may thus introduce an unacceptable risk of the tread 15 overturning due to a load placed at the second end 27, the abutment 43 can be provided with a tread restraining shoulder 80.

As is evident in FIG. 4*b*, the tread restraining shoulder 80 can be provided as the upper portion of a continuous cavity 82 (or channel) that extends along the length of an abutment 43, and which is configured to snugly receive the first end 25 of a tread 15. The restraining shoulder 80 prevents any (or any substantial) movement of the first end 25 of the tread 15 in the direction of arrow M in the response to a load being placed at the second end 27 of the tread 15 and forcing that end downwardly in the direction of arrow N.

To assist with ease of location of the first end 25 into the cavity 82, the first end 25 is also shown in FIG. 4*b* as including a bevel 84 on its lowermost edge.

Figure 5A:
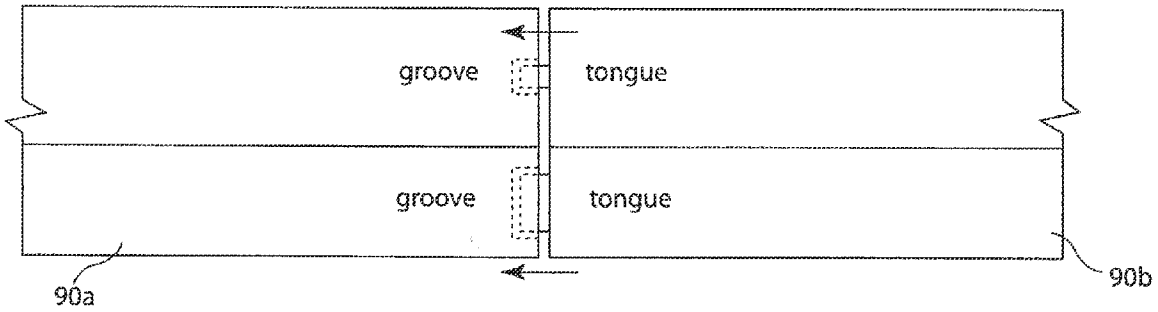
FIGS. 5*a*, 5*b* and 5*c* show preferred forms of abutment engagement systems for use with abutments of the present invention.
Figure 5B:
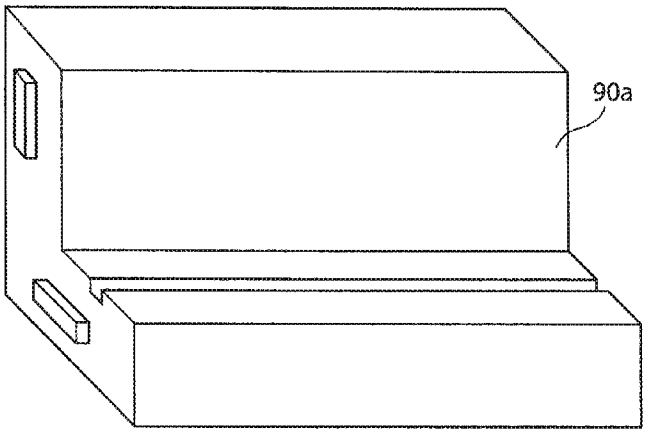
Figure 5C:
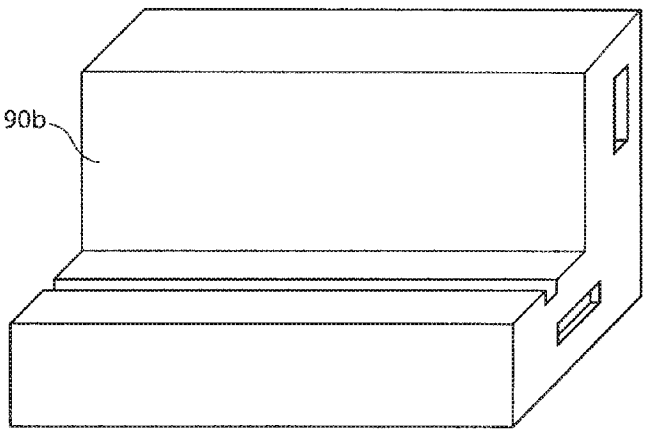
Figure 6C:
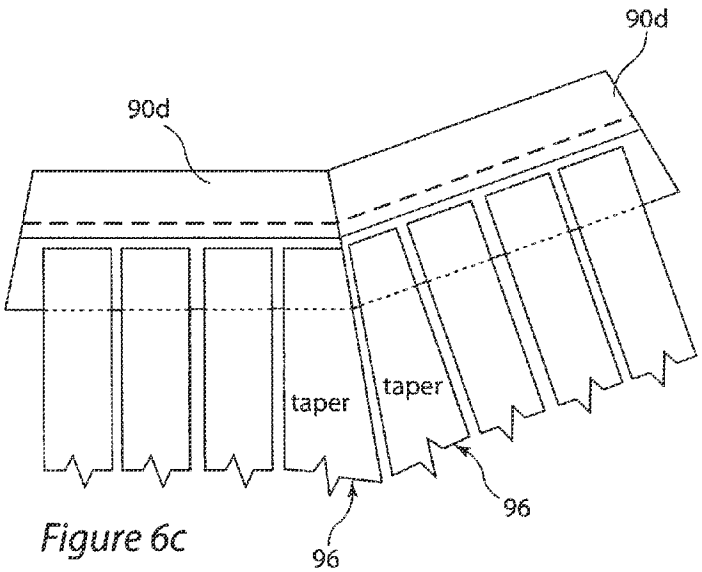
FIGS. 6*a*, 6*b*, 6*c* and 6*d* show preferred configurations of end walls for abutments of the present invention.
Figure 6D:
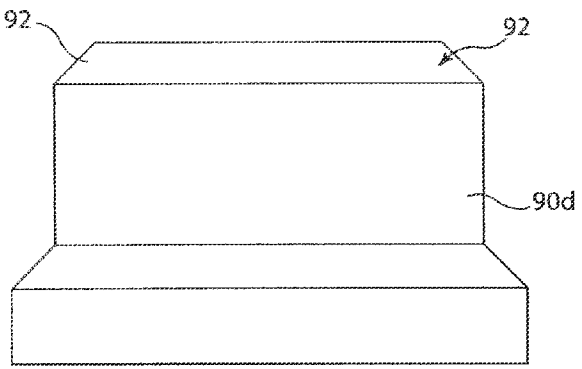
Figure 6A:
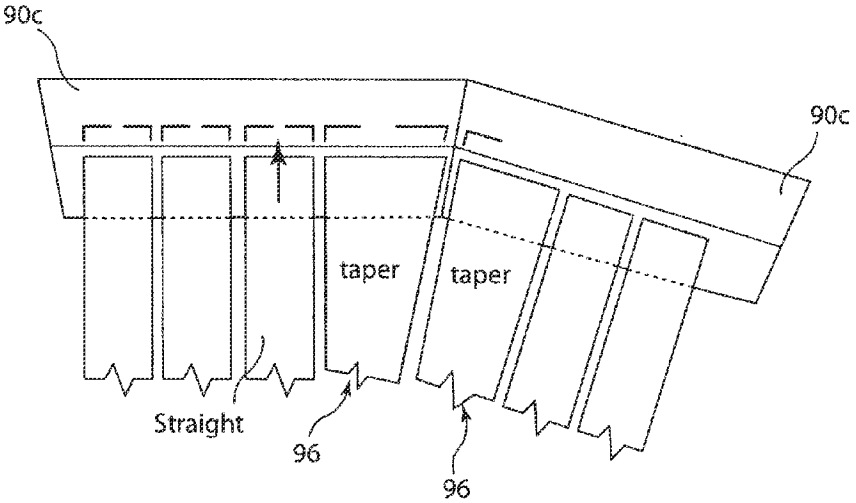
Figure 6B:
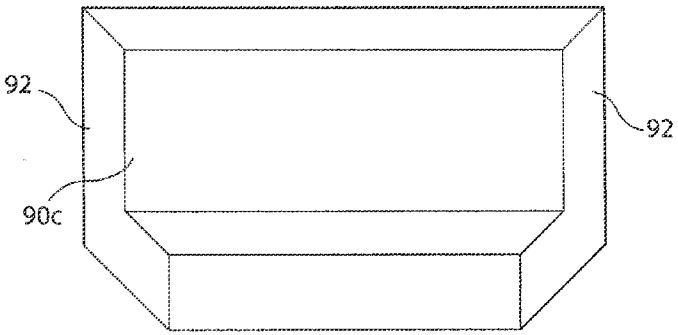

Illustrated in FIGS. 5*a*, 5*b* and 5*c* are two abutments 90*a* and 90*b*, viewed in perspective in FIGS. 5*b* and 5*c* and from above in FIG. 5*a*. These figures illustrate a form of abutment engagement means that could be adopted to assist in connecting one abutment to an adjacent abutment. The abutment engagement means simply includes a form of tongue and groove arrangement on opposed sides of the adjacent abutments 90*a* and 90*b*.

Finally, illustrated in FIGS. 6*a*, 6*b*, 6*c* and 6*d* are alternative forms of abutments 90*c* and 90*d* having tapered end walls 92 to assist with the laying of curvilinear paths (as evident in FIGS. 6*a* and 6*c*) as necessary. As can be seen, this may also require the use of some tapered edges or sides for some treads 96.

In conclusion, it must be appreciated that there may be other variations and modifications to the configurations described herein which are also within the scope of the present invention.

We claim:

1. A modular decking system comprising:

a plurality of distinct treads that are each preformed of a concrete material and to have an elongate configuration including a longitudinal axis, a topside, an underside and two ends having respective end surfaces;

a plurality of distinct tread coupling members with the underside of the first end of each of the concrete treads including one of the tread coupling members;

an abutment of a concrete material, having an elongate configuration including a longitudinal axis, and being sized and configured for cooperating with the plurality of distinct treads for forming decking therewith;

a tread receiving portion of the concrete abutment sized and configured to receive the undersides of the first ends of the plurality of distinct concrete treads with the longitudinal axis of each of the concrete treads extending generally orthogonal to the longitudinal axis of the abutment so that the second end of each of the concrete treads is disposed beyond the abutment tread receiving portion with the topside of each concrete tread exposed to form the decking for pedestrian foot traffic thereon;

at least one bearer member having an elongate configuration including a longitudinal axis with the one bearer member being oriented to support a portion of at least one of the concrete treads disposed beyond the abutment tread receiving portion and so that the longitudinal axis of the one bearer member is substantially parallel to the longitudinal axis of the abutment;

a single abutment coupling member of the tread receiving portion having an elongate configuration to extend along the abutment longitudinal axis so that the single elongate abutment coupling member is adapted for engaging with the plurality of distinct tread coupling members for keeping each of the distinct received concrete treads from moving longitudinally along the longitudinal axis of each of the concrete treads; and an upright margin of the concrete abutment configured such that the end surfaces of the first ends of the plurality of distinct received concrete treads are allowed to lie closely adjacent thereto to provide a border for the decking.

2. A modular decking system according to claim 1, wherein the tread and abutment coupling members are interacting male and female coupling members.

3. A modular decking system according to claim 2, wherein the male coupling member is the tread coupling member.

4. A modular decking system according to claim 3, wherein the male coupling member is a rib or a locating projection extending away from the underside of the first end of each of the treads.

5. A modular decking system according to claim 2, wherein the female coupling member is provided as a part of an upper surface of the tread receiving portion of the abutment coupling member.

6. A modular decking system according to claim 5, wherein the female coupling member is a groove in the tread receiving portion of the abutment.

7. A modular decking system according to claim 1, wherein the upright margin extends upwardly by a distance at least equal to the height of the received treads.

8. A modular decking system according to claim 1, wherein the upright margin extends beyond the height of the received treads to provide a wall as the border of the decking.

9. A modular decking system according to claim 8, wherein a seat is provided on the wall.

10. A modular decking system according to claim 8, wherein the abutment includes a restraining shoulder therein capable of receiving the first end of each of the treads therebelow to prevent substantial vertical movement (off the tread receiving portion) of that first end of the received treads.

11. A modular decking system according to claim 10, wherein the restraining shoulder is provided by a continuous cavity formed in the upright margin, at the location in the upright margin where the end surface of the first end of each of the received treads would normally lie closely adjacent to.

12. A modular decking system according to claim 11, wherein the continuous cavity is configured to snugly receive the first end of each of the received treads such that substantially all vertical movement of that first end is prevented by the restraining shoulder.

13. A modular decking system according to claim 1 wherein abutment engagement means are provided to assist in connecting one abutment to an adjacent abutment, the abutment engagement means including a tongue and groove arrangement on opposed sides of adjacent abutments.

14. A modular decking system according to claim 1, the abutment having tapered end walls to assist with the laying of curvilinear paths.

15. A modular decking system according to claim 1, wherein the abutment is an integral one-piece member made of concrete.

16. A modular decking system comprising:

a plurality of distinct treads that are each preformed of a concrete material and to have an elongate configuration including a longitudinal axis, a topside, an underside and two ends having respective end surfaces;

a plurality of distinct tread coupling members with the underside of the first end of each of the concrete treads including one of the tread coupling members;

an abutment of a concrete material, having an elongate configuration including a longitudinal axis, and being sized and configured for cooperating with the plurality of distinct treads for forming decking therewith;

a tread receiving portion of the concrete abutment sized and configured to receive the undersides of the first ends of the plurality of distinct concrete treads with the longitudinal axis of each of the concrete treads extending generally orthogonal to the longitudinal axis of the abutment so that the second end of each of the concrete treads is disposed beyond the abutment tread receiving portion with the topside of each concrete tread exposed to form the decking for pedestrian foot traffic thereon;

at least one bearer member having an elongate configuration including a longitudinal axis with the one bearer member being oriented to support a portion of at least one of the concrete treads disposed beyond the abutment tread receiving portion and so that the longitudinal axis of the one bearer member is substantially parallel to the longitudinal axis of the abutment;

a single abutment coupling member of the tread receiving portion having an elongate configuration to extend along the abutment longitudinal axis so that the single elongate abutment coupling member is adapted for engaging with the plurality of distinct tread coupling members for keeping each of the distinct received concrete treads from moving longitudinally along the longitudinal axis of each of the concrete treads; and an upright margin of the concrete abutment configured such that the end surfaces of the first ends of the plurality of distinct received concrete treads are allowed to lie closely adjacent thereto to provide a border for the decking, wherein the concrete abutment includes a restraining shoulder thereof capable of receiving the first end of each of the concrete treads therebelow to prevent substantial vertical movement of the first end of the received treads off the tread receiving portion.

17. The modular decking system of claim 16 wherein the at least one concrete tread has a length spanning the two ends thereof sized such that the second end extends beyond the bearer member.

18. A modular decking system comprising:

a plurality of distinct treads that are each preformed of a concrete material and to have an elongate configuration including a longitudinal axis, a topside, an underside and two ends having respective end surfaces;

a plurality of distinct tread coupling members with the underside of the first end of each of the concrete treads including one of the tread coupling members;

an abutment of a concrete material, having an elongate configuration including a longitudinal axis, and being sized and configured for cooperating with the plurality of distinct treads for forming decking therewith;

a tread receiving portion of the concrete abutment sized and configured to receive the undersides of the first ends of the plurality of distinct concrete treads with the longitudinal axis of each of the concrete treads extending generally orthogonal to the longitudinal axis of the abutment so that the second end of each of the concrete treads is disposed beyond the abutment tread receiving portion with the topside of each concrete tread exposed to form the decking for pedestrian foot traffic thereon;

at least one bearer member having an elongate configuration including a longitudinal axis with the one bearer member being oriented to support a portion of at least one of the concrete treads disposed beyond the abutment tread receiving portion and so that the longitudinal axis of the one bearer member is substantially parallel to the longitudinal axis of the abutment;

a single abutment coupling member of the tread receiving portion having an elongate configuration to extend along the abutment longitudinal axis so that the single elongate abutment coupling member is adapted for engaging with the plurality of distinct tread coupling members for keeping each of the distinct received concrete treads from moving longitudinally along the longitudinal axis of each of the concrete treads; and an upright margin of the concrete abutment configured such that the end surfaces of the first ends of the plurality of distinct received concrete treads are allowed to lie closely adjacent thereto to provide a border for the decking, wherein the at least one concrete tread has a length spanning the two ends thereof sized such that the second end extends beyond the bearer member.

* * * * *